US005490342A

United States Patent [19]

Rutterman et al.

[11] Patent Number: 5,490,342

[45] Date of Patent: Feb. 13, 1996

[54] NON-ROTATING WHEEL COVER

[76] Inventors: Michael J. Rutterman, 371 Redland Bay Rd., Capalaba, Queensland, Australia; Leslie Hsiao, 120 Barrington Dr., Brandon, Fla. 33619

[21] Appl. No.: 275,017

[22] Filed: Jul. 13, 1994

[51] Int. Cl.[6] ..... G09F 21/04

[52] U.S. Cl. ..... 40/587; 40/591; 301/37.1; 301/37.25

[58] Field of Search ..... 40/587, 495, 591; 301/37.25, 37.1, 37.36

[56] References Cited

U.S. PATENT DOCUMENTS

| | | | |
|---|---|---|---|
| 2,014,058 | 9/1935 | Towai | 40/587 |
| 2,548,070 | 4/1951 | Ryan | 40/587 |
| 2,869,262 | 1/1959 | Lucas | 40/587 |
| 2,954,629 | 10/1960 | Matin | 40/587 |
| 3,769,729 | 11/1973 | Engler | 40/587 |
| 4,678,239 | 7/1987 | Matsushita | 301/37.25 |

*Primary Examiner*—Peter M. Cuomo
*Assistant Examiner*—James O. Hansen
*Attorney, Agent, or Firm*—A. W. Fisher, III

[57] ABSTRACT

A wheel cover for mounting on a wheel rim comprising a base member having a disc member rotatably mounted thereto to display an indicia thereon, the base member and disc member each includes stabilizing structure configured to mate with each other to maintain concentric alignment and restrict oscillation of the disc member relative to the base member and a counterweight attached to the disc member such that as the base member rotates with the wheel rim the disc member does not rotate relative to the vehicle so that the indicia on the disc member can be viewed as the vehicle translates over the supporting surface.

7 Claims, 3 Drawing Sheets

NON-ROTATING WHEEL COVER

BACKGROUND OF THE INVENTION

1. Field of the Invention

A wheel cover mounted on a wheel rim comprising an inner base member having an outer disc member rotatably mounted thereto to display an indicia thereon.

2. Description of the Prior Art

Most vehicles have wheel covers generally adorned with decorative designs or advertising material.

However, since the wheel covers rotate with the vehicle wheels, the designs, symbols and/or advertising slogans and/or information cannot be easily discerned nor read.

Efforts have been made to construct stationary wheel covers mounted in such a manner that the wheel covers remain in a stationary, non-rotating position while the wheels and hub caps of the vehicle rotate are known to the art. Such covers permit inscriptions, names, monograms, designs and the like, to be attached or inscribed on their outer surface to be readily visible and to remain in a stationary upright position, notwithstanding the rotation of the wheels and hub caps of the vehicle.

Often such wheel covers lack stability and tend to oscillate about the axis of rotation of the hub caps on which the assemblies are mounted.

U.S. Pat. No. 5,190,354 describes a wheel cover comprising a rotatable shield element for rotation to maintain a fixed angular position relative to the horizontal even during rotation of the wheel. There is a connection between the securement and support device and the shield element comprising a roller bearing mounted on the support shaft by an annular intermediate member disposed adjustably between an internal ring of the roller bearing and the support shaft, and delimited by a perforated disk, whose diameter corresponds to that of the internal ring.

U.S. Pat. No. 4,929,030 shows a hub cap having at its center a static lateral axis, a supporting plate fixed to the inner side of the hub cap and a clutch plate fixed at one of its ends to the inner end of the lateral axle. The clutch plate includes an eccentric bob fixed at its other end. A static member is fixed to the outer end of the lateral axis and having a second eccentric bob connected thereto. A rear cover is connected to the inner side of the hub cap and covers the support plate and clutch plate.

U.S. Pat. No. 4,280,293 teaches a stationary display member mounted on the rotating hub cap comprising a disc-like member coaxially mounted on the hub cap to be freely rotatable about the axis of rotation of the hub cap. The disc-like member has an internal chamber which is partially filled with a flowable material that collects at the bottom of the chamber to form an off-set weight which prevents the disc-like member from turning as the hub cap turns about its axis of rotation. A damping device included in the chamber coacts with the flowable material to dampen any tendency for the disc-like member to oscillate about the axis of rotation of the hub cap. An appropriate insignia, design, message or other inscription is imprinted or attached to the outer face of the disc-like member and remains stationary as the hub cap rotates.

German (DE) 3,919,268 describes a hubcap consisting of an inner member having means both to attach the hubcap to a wheel and to support a rotatable outer member. The outer member is fitted at one edge with a weight that helps prevent the outer member rotating with the inner member.

U.S. Pat. No. 1,478,475 shows an advertising device for vehicles comprising a cap adapted to be screwed on to the wheel-hub, a spindle and a ball bearing supporting the spindle in the cap. A portion of the inner part of the ball bearing forms a shoulder with the spindle.

U.S. Pat. No. 2,014,058 teaches a hubcap comprising a body having a concavity in the face to provide an inner wall, a hub secured to the inner wall, a name plate closing the concavity, a shaft secured to the name plate and mounted for rotation in the hub and means to normally hold the name plate stationary when the wheel is in motion.

U.S. Pat. No. 3,769,729 describes a display apparatus including a main plate of a diameter such that its peripheral edge portion is abuttingly secured to a vehicle wheel rim and on which is rotatably mounted a display disk held by a counterweight against rotation where the wheel is rotating, and a transparent cover for the disk whose edge flange is separably secured to the peripheral edge portion of the main plate.

British (GB) 281,602 shows the arrangement of non-rotating discs fixed to non-rotating axles on the outer side of wheels of vehicles for the display of advertising.

Great Britain 1,188,397 teaches an advertising display attachment for use with a vehicle wheel assembly comprising a non-rotatable axle having a threaded end, a hub rotatably mounted on the axle and a nut engaging the threaded axle end to maintain the hub on the axle. The advertising display attachment comprises a support member having an end wall and a peripheral side wall disposed substantially perpendicular to the end wall and adapted to receive the nut. A stepped annular backing member is adapted for mounting on the axle between the nut and the hub; while, an annular sealing element is adapted to be disposed between the backing member and the hub. A securing means is provided at the end wall of the support member adapted to carry an advertising display plate. The arrangement being such that in the assembled configuration on the wheel assembly, the support member and backing member enclose the nut and the hub is still capable of rotation on the axle and with respect to the support and backing member.

SUMMARY OF THE INVENTION

The present invention relates to a wheel cover for mounting on a wheel rim comprising a base member having a disc member rotatably mounted thereto. The base member and disc member are obversely configured to mate with each other to maintain concentric alignment and limit oscillation of the disc member relative to the base member.

The base member comprises an inner base element and an outer base element attached to the rim by a plurality of legs. The inner base element comprises a base including a base hub and a base tongue extending outwardly therefrom and disposed in spaced relationship relative to the base hub to cooperatively form a substantially circular base groove therebetween. The outer base element comprises an annular plate extending between the outer periphery of the base and the outer base element comprising a substantially Z-shaped cross-section including an inner member and an outer member held in substantially parallel spaced relationship relative to each other by an inclined interconnecting member having an inclined base surface. The base tongue and inclined interconnecting member cooperatively form a base channel therebetween.

The disc member comprises a disc element including a flat outer surface on which indicia or designs are formed, a disc hub having a counter-sunk recess 64 formed therein to receive and retain a disc mounting element therein, a disc tongue extending outwardly from the disc member and disposed in spaced relationship relative to the disc hub to cooperatively form a hub alignment recess therebetween. A disc ridge is formed in spaced relationship relative to the disc tongue to cooperatively form a disc groove therebetween. The peripheral edge of the disc element comprises an inclined disc surface. A plurality of recesses are formed in the disc tongue to house a corresponding plurality of weights to collectively form a means to limit or restrict rotation of the substantially circular disc member.

When assembled, the base hub is disposed within the hub alignment recess, the disc tongue is disposed within the base groove, the base tongue is disposed within the disc groove and the disc ridge is disposed within the base channel within the inclined base surface disposed immediately adjacent the inclined disc surface. So configured and assembled, these corresponding structural elements are operatively disposed relative to each other to limit the oscillation of the base member relative to the disc member to stabilize and limit lateral movement of the disc member relative to the base member.

In use, an appropriate inscription is formed on the flat outer surface of the disc member. When the tire and wheel rim rotate, the disc member remains rotationally stationary, not rotating with the wheel rim. This is because the weights retain the disc member upright.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

As shown in FIGS. 1 through 4, the present invention relates to a wheel cover generally indicated as 10 for mounting on a wheel rim 12 configured to mount a tire 14 to an axle 16 operatively coupled to a vehicle generally indicated as 18.

Figure 1:
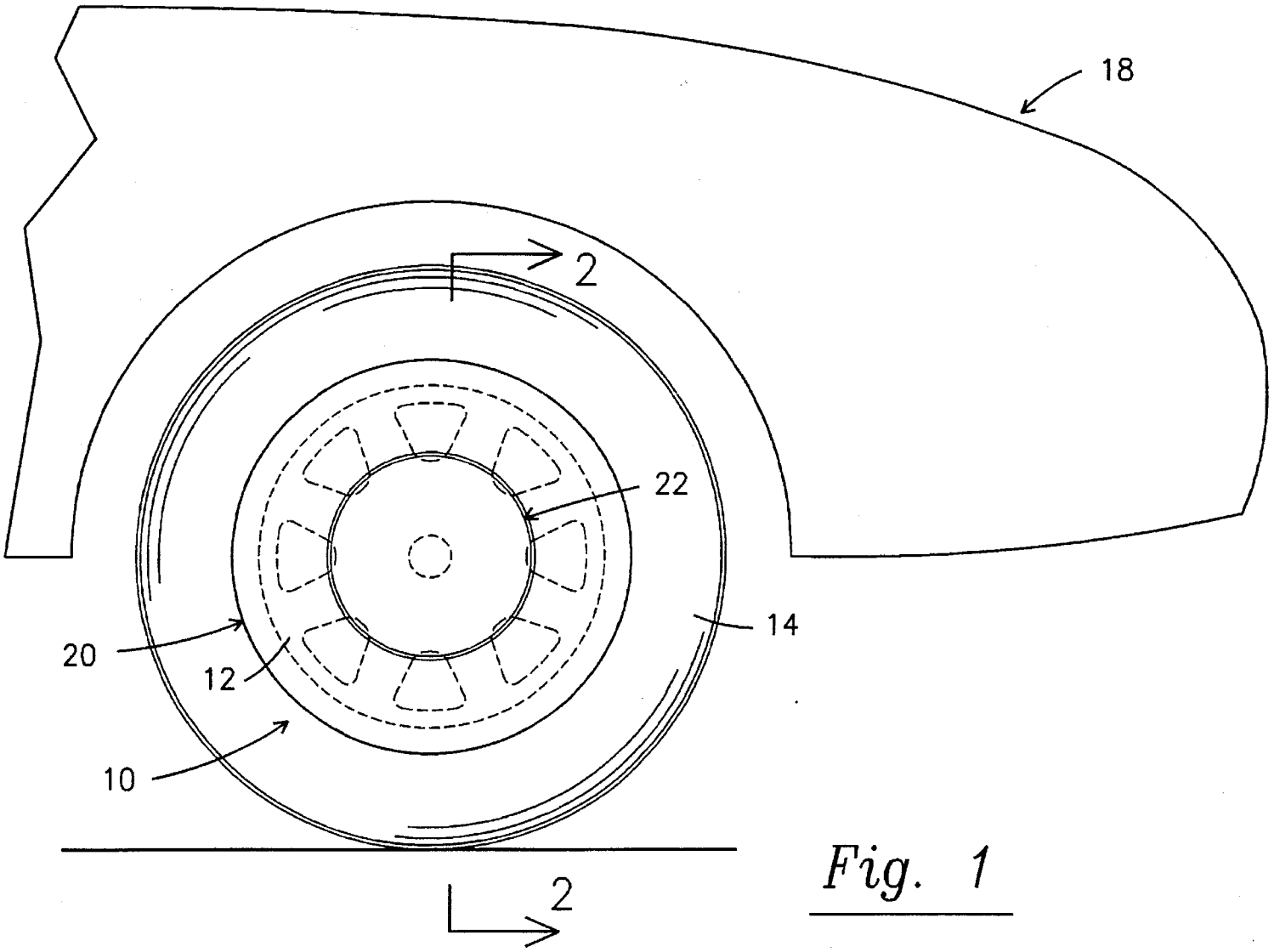
FIG. 1 is a side view of the wheel cover mounted on a wheel rim supporting a tire thereon.
Figure 2:
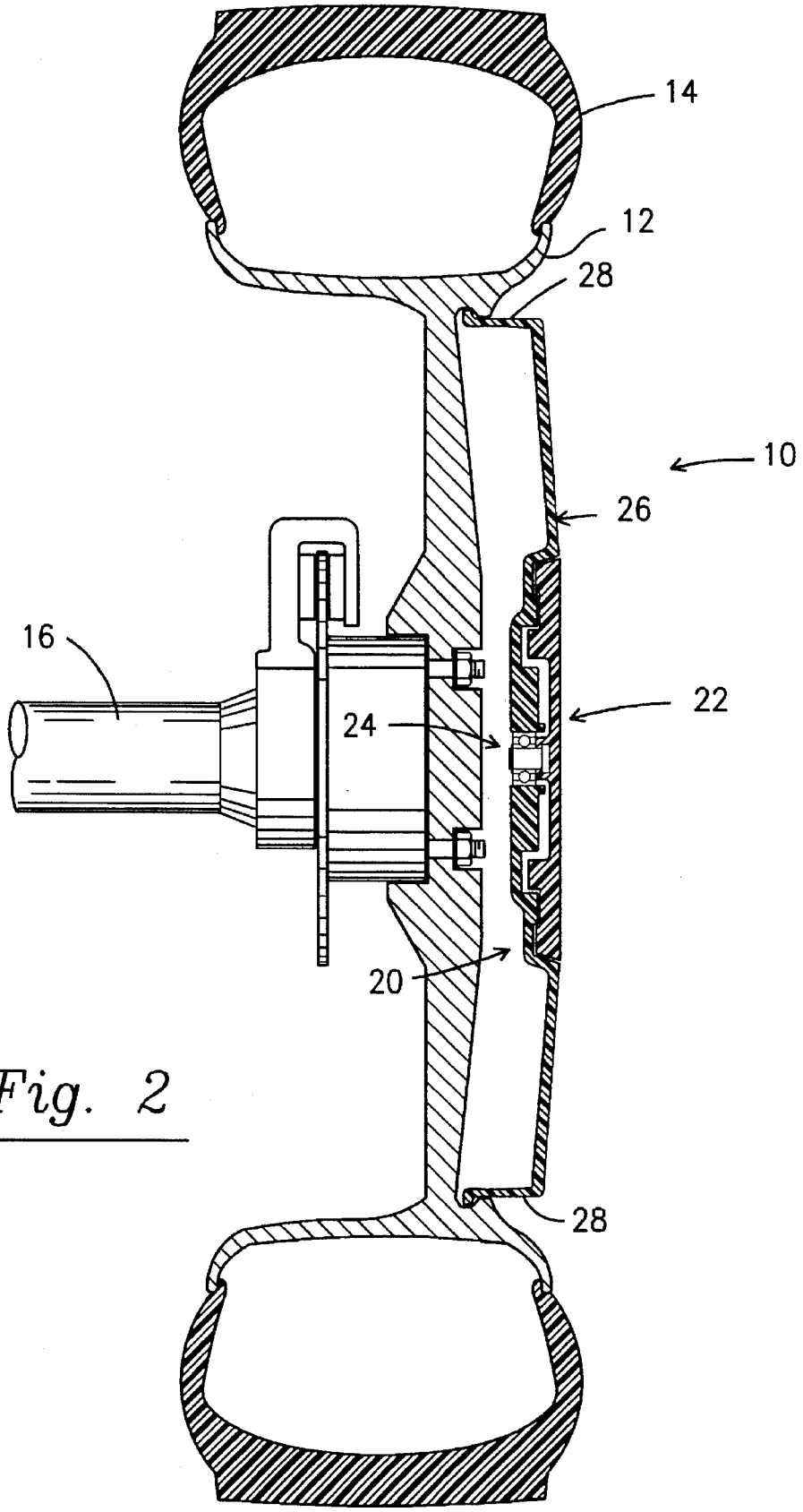
FIG. 2 is a cross-sectional end view of the wheel cover mounted on a wheel rim supporting a tire thereon taken along line 2—2 of FIG. 1.
Figure 3:
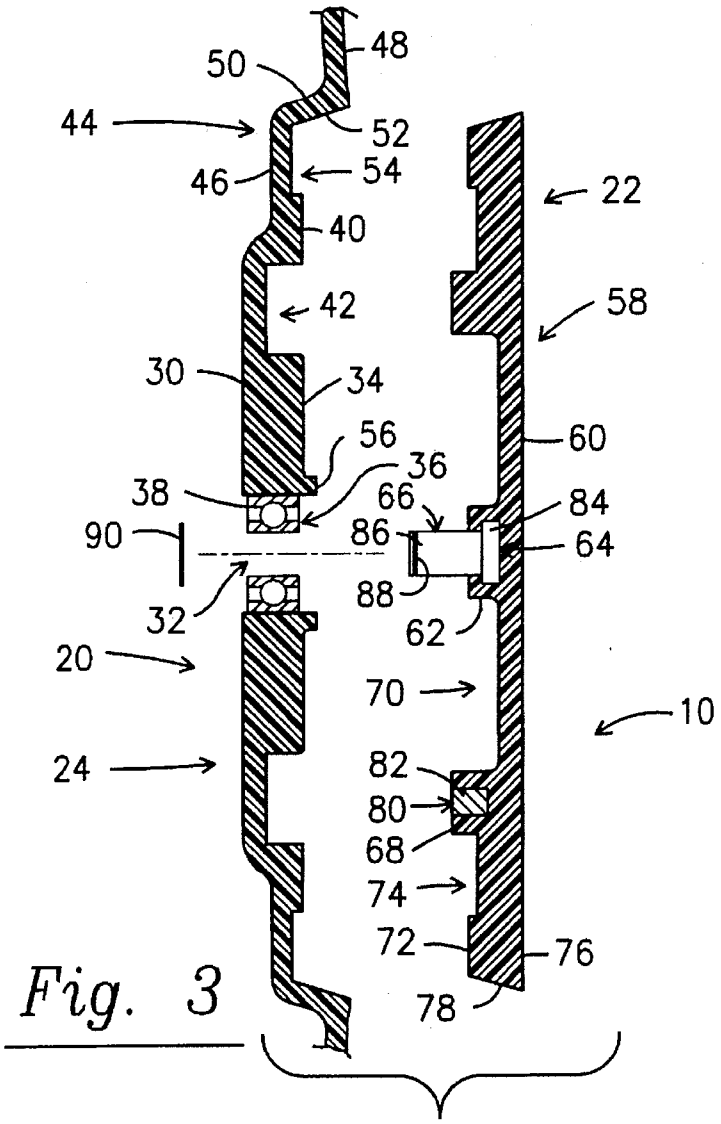
FIG. 3 is an exploded cross-sectional end view of the wheel cover.

As best shown in FIGS. 1 through 3, the wheel cover 10 comprises a substantially circular base member generally indicated as 20 having a substantially circular disc member generally indicated as 22 rotatably mounted thereto.

As described more fully hereinafter, the substantially circular base member 20 and the substantially circular disc member 22 are obversely configured to mate with each other to maintain concentric alignment and limit oscillation of the substantially circular disc member 22 relative to the substantially circular base member 20.

As best shown in FIG. 3, the substantially circular base member 20 comprises an inner base element generally indicated as 24 configured to operatively receive and support the substantially circular disc member 22 thereon as described more fully hereinafter and an outer base element generally indicated as 26 attached to the rim 12 by a plurality of legs each indicated as 28.

As best shown in FIG. 3, the inner base element 24 comprises a substantially circular base 30 including a substantially cylindrical base hub 34 having a centrally disposed aperture 36 formed therethrough to operatively receive and house a bearing 38 with a channel 32 therein and a substantially circular base tongue 40 extending outwardly from the substantially cylindrical base 30 and disposed in spaced relationship relative to the substantially cylindrical base hub 34 to cooperatively form a substantially circular base groove 42 therebetween.

As best shown in FIGS. 2 and 3, the outer base element 26 comprises a substantially annular plate generally indicated as 44 extending between the outer periphery of the substantially circular base 30 and the outer base element 26. The substantially annular plate 44 comprises a substantially Z-shaped cross-section including an inner member 46 and an outer member 48 held in substantially parallel spaced relationship relative to each other by an inclined interconnecting member 50 having an inclined base surface 52. The substantially circular base tongue 40 and inclined interconnecting member 50 cooperatively form a substantially circular base channel 54 therebetween.

As best shown in FIG. 3, an annular limit rim 56 extends outwardly from the surface of the substantially cylindrical base hub 34 adjacent the centrally disposed aperture 36.

Figure 4:
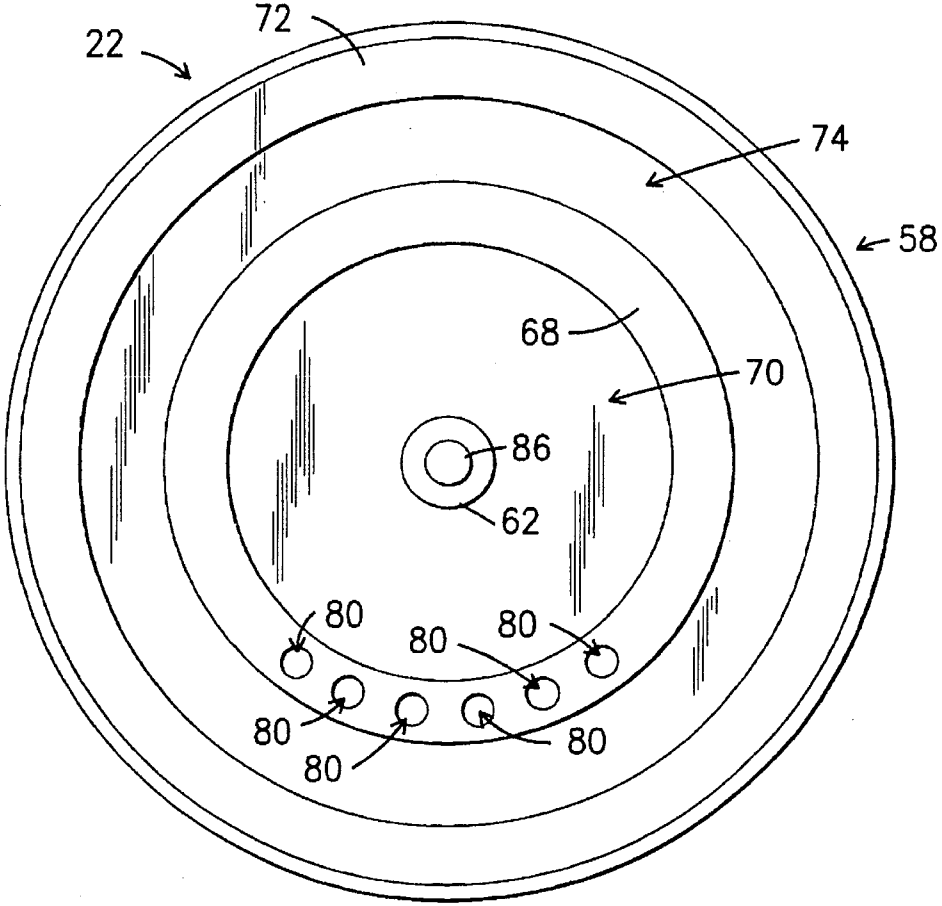
FIG. 4 is a rear view of the disc member of the wheel cover.

As best shown in FIGS. 3 and 4, the substantially circular disc member 22 comprises a substantially circular disc element generally indicated as 58 including a flat outer surface 60 on which indicia or designs are formed, a substantially cylindrical disc hub 62 having a counter-sunk recess 64 formed therein to receive and retain a disc mounting element generally indicated as 66 therein, a substantially circular disc tongue 68 extending outwardly from the substantially circular disc member 22 and disposed in spaced relationship relative to the substantially cylindrical disc hub 62 to cooperatively form a substantially circular hub alignment recess 70 therebetween. A substantially circular disc ridge 72 is formed in spaced relationship relative to the substantially circular disc tongue 68 to cooperatively form a substantially circular disc groove 74 therebetween. The peripheral edge 76 of the substantially circular disc element 58 comprises an inclined disc surface 78.

As best shown in FIGS. 3 and 4, a plurality of recesses each indicated as 80 are formed in the substantially circular disc tongue 68 to house a corresponding plurality of weights each indicated as 82 to collectively form a means to limit or restrict rotation of the substantially circular disc member 22.

As best shown in FIG. 3, the disc mounting element 66 comprises an enlarged retainer end 84 having an elongated disc mounting member 86 extending outwardly therefrom to pass through the channel 32. The substantially circular disc member 22 is retained on the substantially circular base member 20 by the engagement of a lock recess 88 formed on the end portion of the elongated disc mounting member 86 and lock ring 90.

As previously set forth, the substantially circular base member 20 and the substantially circular disc member 22 are obversely configured to mate with each other to maintain concentric alignment and limit oscillation of the substantially circular disc member 22 relative to the substantially circular base member 20.

Specifically, when assembled, as best shown in FIGS. 2 and 3, the substantially cylindrical base hub 34 is disposed within the substantially circular hub alignment recess 70 with the annular limit rim 56 immediately adjacent the substantially cylindrical disc hub 62, the substantially circular disc tongue 68 is disposed within the substantially circular base groove 42, the substantially circular base tongue 40 is disposed within the substantially circular disc groove 74 and the substantially circular disc ridge 72 is disposed within the substantially circular base channel 54 within the inclined base surface 52 disposed immediately adjacent the inclined disc surface 78. So configured and assembled, the annular limit rim 56 and the substantially cylindrical disc hub 62, the substantially cylindrical base hub 34 and the substantially circular hub alignment recess 70, the substantially circular disc tongue 68 and the substantially circular base groove 42, the substantially circular base tongue 40 and the substantially circular groove 74, the substantially circular ridge and the substantially circular channel 54, and the inclined base surface 52 and the inclined disc surface 78 are operatively disposed relative to each other to limit the oscillation of the substantially circular base member 20 relative to the substantially circular disc member 22 to stabilize and limit lateral movement of the substantially circular disc member 22 relative to the substantially circular base member 20.

In use, an appropriate inscription is formed on the flat outer surface 60 of the substantially circular disc member 22. When the tire 14 and wheel rim 12 mounted on the axle 16 rotate, the substantially circular disc member 22 remains rotationally stationary, not rotating with the wheel rim 12. This is because the weights 82 retain the substantially circular disc member 22 upright with the disc mounting element 66 disposed within the bearing 38.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A wheel cover for mounting on a wheel rim rotationally coupled to a vehicle, said wheel cover comprising a base member having a disc member rotatably mounted thereto to display an indicia thereon, said base member including a base stabilizing means and said disc member includes disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member comprises an inner base element configured to operatively support said disc member thereon and said disc member comprises a disc element, said base stabilizing means comprising a base hub formed on said inner base element and said disc stabilizing means comprising a hub alignment recess formed in said disc element disposed to receive at least a portion of said base hub therein, said disc stabilizing means further includes a disc hub formed on said disc element and said base stabilizing means further includes an annular limit rim extending outwardly from said base hub disposed to receive at least a portion of said disc hub therein, said disc stabilizing means further includes a disc tongue extending outwardly from said disc element and said base stabilizing means further includes a base groove formed on said inner bass element to receive at least a portion of said disc tongue therein and said base stabilizing means further includes a base tongue extending outwardly from said base member and said disc stabilizing means further includes a disc groove formed on said disc element to receive at least a portion of said base tongue therein, said base member further includes an outer base element comprising an annular plate extending from an outer periphery of said inner base element, said disc stabilizing means further includes a disc ridge extending outwardly from said disc element and said base stabilizing means further includes a base channel formed on said annular plate and disposed to receive at least a portion of said disc ridge therein.

2. The wheel cover of claim 1 wherein said base stabilizing means further includes an inclined base surface formed on a periphery of said annular plate and said disc stabilizing member further includes an inclined base surface disposed adjacent said inclined base surface and substantially parallel thereto.

3. A wheel cover for mounting on a wheel rim rotationally coupled to a vehicle, said wheel cover comprising a base member having a disc member rotatably mounted thereto to display an indicia thereon, said base member including a base stabilizing means and said disc member includes disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member comprises an inner base element configured to operatively support said disc member thereon and said disc member comprises a disc element, said base stabilizing means comprising a base hub formed on said inner base element and said disc stabilizing means comprising a hub alignment recess formed in said disc element disposed to receive at least a portion of said base hub therein, said base member further includes an outer base element comprising an annular plate extending from an outer periphery of said inner base element, said disc stabilizing further includes a disc ridge extending outwardly from said disc element and said base stabilizing a further includes a base channel formed on said annular plate and disposed to receive at least a portion of said disc ridge therein, said base stabilizing means further includes an inclined base surface formed on a periphery of said annular plate and said disc stabilizing member further includes an inclined base surface disposed adjacent said inclined base surface and substantially parallel thereto, said base stabilizing means further includes a base tongue extending outwardly from said base member and said disc stabilizing means further includes a disc groove formed on said disc element to receive at least a portion of said base tongue therein, said disc stabilizing means further includes a disc tongue extending outwardly from said disc element and said base stabilizing means further includes a base groove formed on said inner base element to receive at least a portion of said disc tongue therein.

4. The wheel cover of claim 3 wherein said disc stabilizing means further includes a disc hub formed on said disc element and said base stabilizing means further includes an annular limit rim extending outwardly from said base hub disposed to receive at least a portion of said disc hub therein.

5. A wheel cover for mounting on a wheel rim rotationally coupled to a vehicle, said wheel cover comprising a base member having a disc member rotatably mounted thereto to display an indicia thereon, said base member including a base stabilizing means and said disc member includes disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member further includes an outer base element comprising an annular plate extending from an outer periphery of said inner base element, said disc stabilizing means further includes a disc ridge extending outwardly from said disc element and said base stabilizing means further includes a base channel formed on said annular plate and disposed to receive at least a portion of said disc ridge therein, said base stabilizing means further includes an inclined base surface formed on a periphery of said annular plate and said disc stabilizing member further includes an inclined base surface disposed adjacent said inclined base surface and substantially parallel thereto, said base member comprises an inner base element configured to operatively support said disc member thereon and said disc member comprises a disc element, said base stabilizing means comprising a base hub formed on said inner base element and said disc stabilizing means comprising a hub alignment recess formed in said disc element disposed to receive at least a portion of said base hub therein, said disc stabilizing means further includes a disc hub formed on said disc element and said base stabilizing means further includes an annular limit rim extending outwardly from said base hub disposed to receive at least a portion of said disc hub therein.

6. A wheel cover for mounting on a wheel rim rotationally coupled to a vehicle, said wheel cover comprising a base member having a disc member rotatably mounted thereto to display an indicia thereon, said base member includes a base stabilizing means and said disc member includes disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member further includes an outer base element comprising an annular plate extending from an outer periphery of said inner base element, said disc stabilizing means further includes a disc ridge extending outwardly from said disc element and said base stabilizing means further includes a base channel formed on said annular plate and disposed to receive at least a portion of said disc ridge therein, said base stabilizing means further includes an inclined base surface formed on a periphery of said annular plate and said disc stabilizing member further includes an inclined base surface disposed adjacent said inclined base surface and substantially parallel thereto, said base member comprises an inner base element configured to operatively support said disc member thereon and said disc member comprises a disc element, said base stabilizing means comprising a base hub formed on said inner base element and said disc stabilizing means comprising a hub alignment recess formed in said disc element disposed to receive at least a portion of said base hub therein, said disc stabilizing means further includes a disc tongue extending outwardly from said disc element and said base stabilizing means further includes a base groove formed on said inner base element to receive at least a portion of said disc tongue therein.

7. A wheel cover for mounting on a wheel rim rotationally coupled to a vehicle, said wheel cover comprising a base member having a disc member rotatably mounted thereto to display an indicia thereon, said base member includes a base stabilizing means and said disc member includes disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member further includes an outer base element comprising an annular plate extending from an outer periphery of said inner base element, said disc stabilizing means further includes a disc ridge extending outwardly from said disc element and said base stabilizing means further includes a base channel formed on said annular plate and disposed to receive at least a portion of said disc ridge therein, said base stabilizing means further includes an inclined base surface formed on a periphery of said annular plate and said disc stabilizing member further includes an inclined base surface disposed adjacent said inclined base surface and substantially parallel thereto, said base member comprises an inner base element configured to operatively support said disc member thereon and said disc member comprises a disc element, said base stabilizing means comprising a base hub formed on said inner base element and said disc stabilizing means comprising a hub alignment recess formed in said disc element disposed to receive at least a portion of said base hub therein, and said base stabilizing means further includes a base tongue extending outwardly from said base member and said disc stabilizing means further includes a disc groove formed on said disc element to receive at least a portion of said base tongue therein.

* * * * *